United States Patent [19]

Elliott

[11] 4,387,658

[45] Jun. 14, 1983

[54] WHEEL STEERING APPARATUS FOR BOATS

[76] Inventor: Theodore Elliott, 384 Summer St., Manchester, Mass. 01944

[21] Appl. No.: 340,667

[22] Filed: Jan. 19, 1982

Related U.S. Application Data

[63] Continuation of Ser. No. 863,061, Dec. 21, 1977, abandoned, which is a continuation of Ser. No. 700,878, Jun. 29, 1976, abandoned.

[51] Int. Cl.[3] ..... B63H 25/10

[52] U.S. Cl. ..... 114/144 R; 114/160

[58] Field of Search ..... 114/144 R, 154, 160, 114/161; 254/372

[56] References Cited

U.S. PATENT DOCUMENTS

| | | | |
|---|---|---|---|
| 8,546 | 11/1851 | Mortimer | 114/160 |
| 118,176 | 8/1871 | Drew | 114/160 |
| 2,141,670 | 12/1938 | Robertson | 242/117 |
| 2,835,135 | 5/1958 | Quick | 74/98 |
| 3,403,578 | 10/1968 | Morse | 114/160 |
| 3,815,537 | 6/1974 | Evans | 114/144 R |
| 4,040,375 | 8/1977 | Atkins et al. | 114/144 R |

FOREIGN PATENT DOCUMENTS

| | | | |
|---|---|---|---|
| 426385 | 4/1935 | United Kingdom | 114/160 |

OTHER PUBLICATIONS

"Yachting", Jul. 1975, p. 89.

Edson Catalogue,-K-7, 1972, p. 56.

"News, News, News", Edson Corporation, 460 Industrial Park Road, New Bedford, Mass. 02745, Jun. 20-23, 1975.

"Steering Data Sheet S-717", Edson Corporation, 460 Industrial Park Road, New Bedford, Mass. 02745, sent out Jun. 20-23, 1975.

*Primary Examiner*—Sherman D. Basinger

*Attorney, Agent, or Firm*—Cesari and McKenna

[57] ABSTRACT

A wheel steering apparatus for a boat. A pedestal housing is mounted onto a cockpit sole or other support member. The housing supports a shaft and sprocket that are rotated by a wheel. A sheave is mounted onto the rudder post that extends from the rudder. A chain and cable linkage couples the sprocket and the sheave to pivot the sheave as the wheel rotates the sprocket. The pedestal housing encloses the entire assembly. The apparatus is particularly suited to convert boats steered by a tiller normally attached to the rudder post to wheel steering.

1 Claim, 5 Drawing Figures

WHEEL STEERING APPARATUS FOR BOATS

This is a continuation, of application Ser. No. 863,061 filed Dec. 21, 1977, now abandoned, which is a continuation of application Ser. No. 700,878, filed June 29, 1976, now abandoned.

BACKGROUND OF THE INVENTION

This invention generally relates to wheel steering apparatus for boats and more specifically to the conversion of tiller-controlled steering to a wheel-controlled steering for such boats.

Pleasure boats, typically sail boats, employ either tiller steering or wheel steering. Tiller steering is generally less expensive to implement because a tiller merely comprises a simple lever that is affixed to the end of a rudder post. The rudder post connects to the rudder and extends up through the hull to a position above a cockpit sole. Tillers have some disadvantages, however. They usually are relatively long and they can be swung over normal seating areas. As a result, passengers oftentimes have to move during certain steering maneuvers in order that they do not interfere with tiller movement.

It also is difficult for novices to become familiar with the tiller steering because movement of the tiller in one direction produces a change in direction that is opposite to the expected change while the sailboat is travelling in the forward direction. That is, if the tiller is moved aport, the boat turns to starboard. On the other hand, wheel steering normally has none of these advantages. Wheel steerers are extremely compact. The reaction of the sailboat to movement of steering wheel is the same as the reaction of an automobile. That is, if the boat is to be swung to starboard, the helmsman turns the wheel clockwise, or to starboard. As a result it has become popular for owners of boats that are manufactured with tiller steering to replace the tiller with wheel steering apparatus.

In the prior art, the conversion is made by mounting a pedestal to the cockpit sole after a hole is put through the sole to receive a depending structure from the pedestal. A quadrant gear is then affixed to the rudder post below the cockpit sole and connected to the pedestal through a complex assembly of cables, chains and pulleys.

Such conversion apparatus has several disadvantages. It is difficult to install because working beneath the cockpit sole in a sailboat, especially a sailboat with auxiliary power, is very difficult. The existence of a large hole in the cockpit sole exposes the bilge, so extreme care in sealing the base of the pedestal to the sole is necessary. However, the pedestal is very high, and it is subject to bending forces during use. Such bending forces further complicate the sealing operation.

Furthermore, the rudder post oftentimes rides in a tube that terminates at the upper surface of the cockpit sole at the top and at the outer surface of the hull at the bottom. The tube thereby provides a sealed passage through the bilge. Even if water were to be forced up the tube, the water would discharge into the cockpit and drain out cockpit scuppers. In such an arrangement, the tube must be cut to apply the quadrant gear thereby eliminating this integral, water-tight passage. Any leakage, that may then occur, will discharge into the bilge unless a seal is affixed to the top of the tube beneath the quadrant.

It will also be apparent that if the wheel steerer were to malfunction, conversion back to tiller steering during an emergency could be difficult with these prior conversion systems. Oftentimes the exposed end of the rudder post that extended above the cockpit sole is removed to provide smooth footing. Reconnection of the tiller is very difficult. Whether or not the exposed end of the rudder post is removed, it also is difficult to remove the pedestal and disconnect it from the quadrant gear. The pedestal normally must be removed and disconnected from the quadrant gear before the tiller can be attached to the rudder post in order that the pedestal not interfere with any motion of the tiller.

Therefore, it is an object of this invention to provide an improved wheel steering apparatus for a boat. It also is an object of this invention to provide apparatus that simplifies the conversion of tiller steering to wheel steering.

Another object of this invention is to provide a wheel steering apparatus which is easily removed for conversion back to tiller steering, if necessary or desired.

Still another object of this invention is to provide a wheel steering apparatus which, in one embodiment, is disposed entirely above the cockpit sole.

SUMMARY OF THE INVENTION

In accordance with one aspect of this invention, a wheel steering conversion apparatus includes a housing that is mounted on the cockpit sole of a boat. A steering wheel and shaft are mounted for rotation about an axis that is parallel to the pitch axis of the boat. An annular sheave mounts to the upper end of the rudder post. A linkage interconnects the sheave and the wheel to convert the rotational motion of the wheel into oscillatory motion of the sheave and rudder post.

This invention is pointed out with particularity in the appended claims. A more thorough understanding of the above and further objects of this invention may be attained by referring to the following description taken in conjunction with the accompanying drawings.

DESCRIPTION OF AN ILLUSTRATIVE EMBODIMENT

Figure 1:
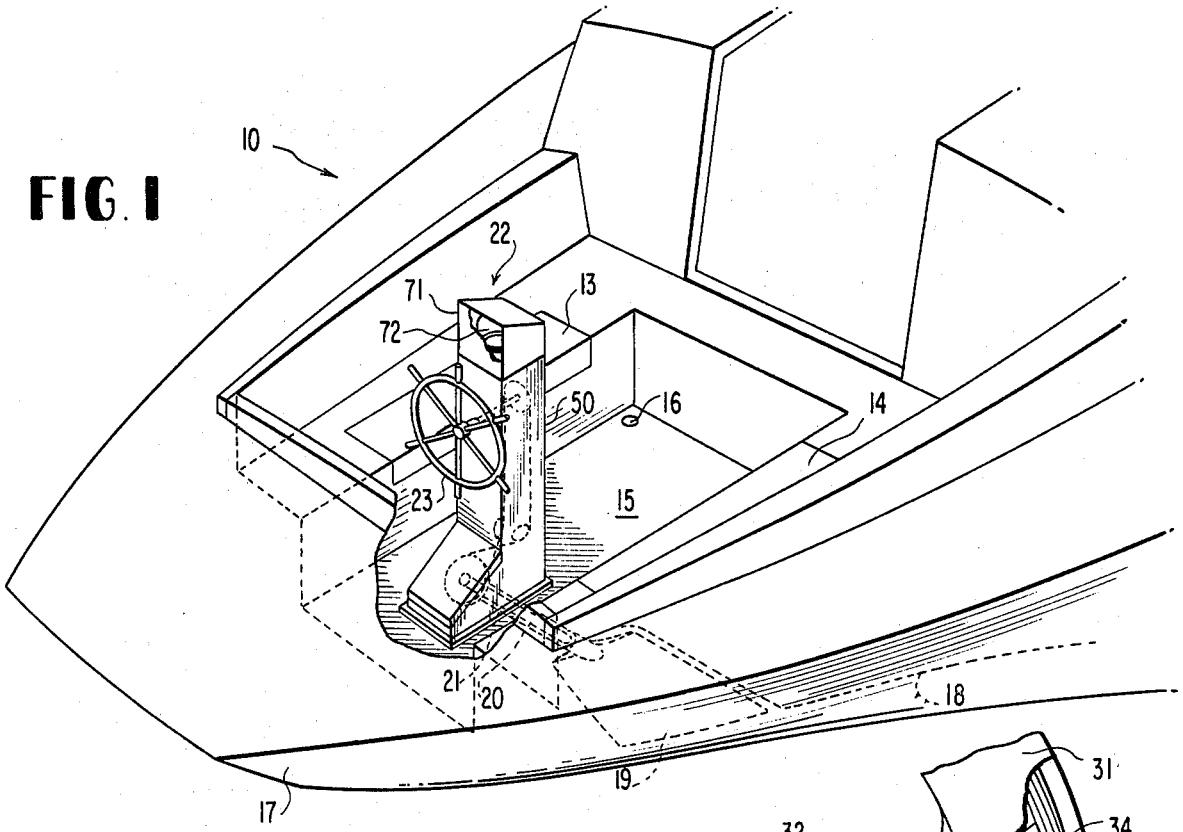
FIG. 1 is a pictorial view of the aft section of a sailboat including a wheel steering conversion apparatus constructed in accordance with this invention.

FIG. 1 pictorially depicts the aft section 10 of a sailboat including sail lockers 13 and 14 and a cockpit sole 15. Conventionally scuppers 16 extend from the cockpit sole 15 through a hull 17 to afford drainage of the cockpit. A keel 18 and a rudder 19, that is aft of the keel 18, depend from the hull 17 thereby to stabilize the boat and provide steerage of the boat, respectively.

A rudder post 20, shown in phantom, passes through a tube 21 and terminates above the cockpit sole 15. Normally a tiller is affixed to the protruding end of the rudder post 20. As shown in FIG. 1, however, a wheel steering apparatus 22 including a wheel 23 is mounted over the protruding end of the rudder post 20.

Figure 5:
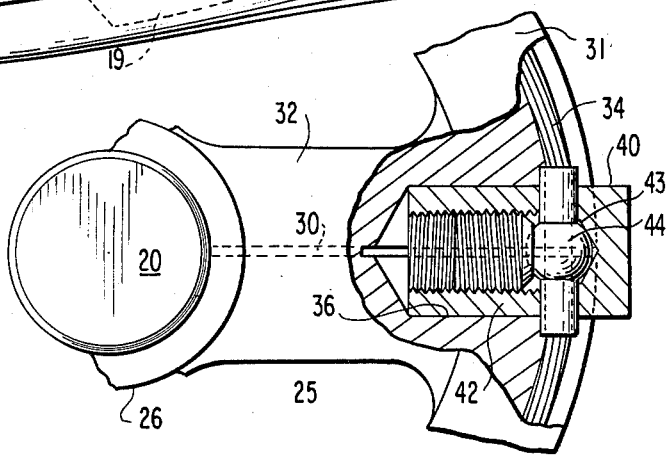
FIG. 5 is a detailed view of a horizontal section of a cable anchoring assembly that is shown in FIG. 4.
Figure 4:
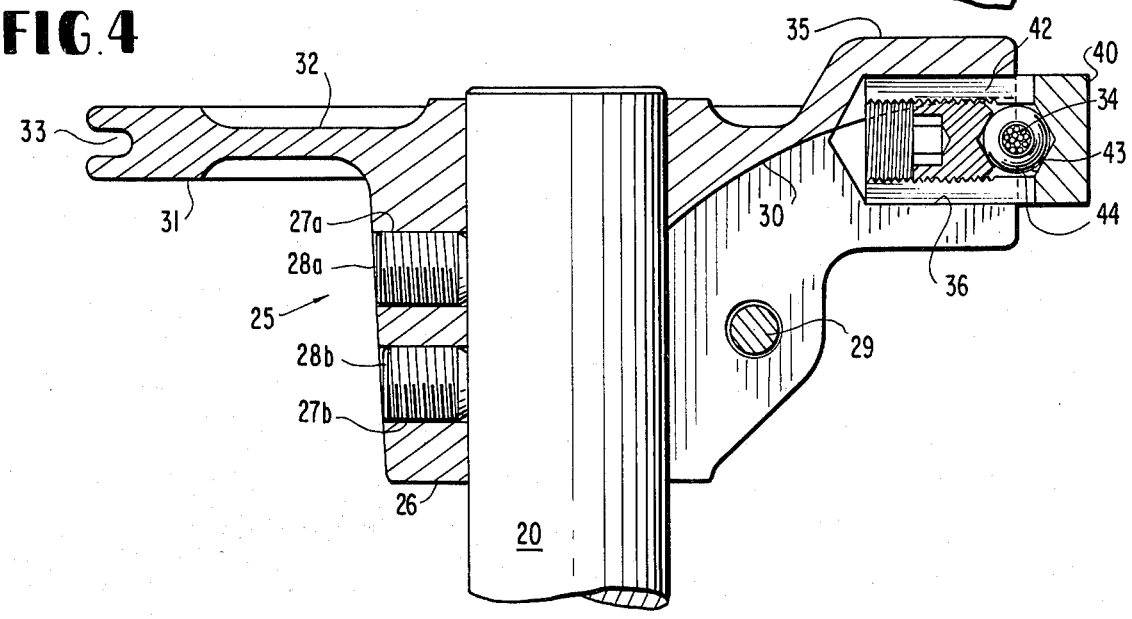
FIG. 4 is a partial sectional view of a sheave shown in FIG. 2 as it mounts on a rudder post.
Figure 2:
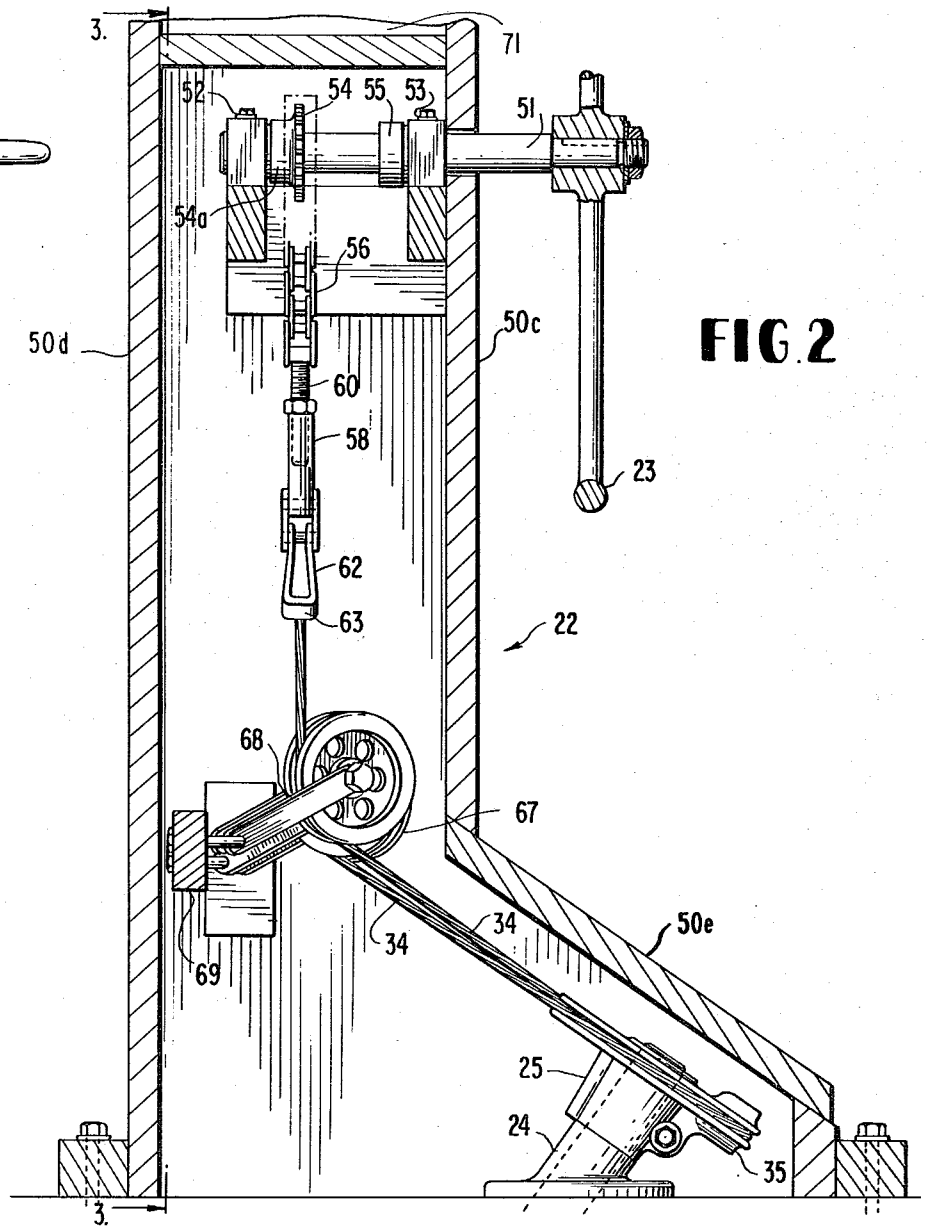
FIG. 2 is a view of the wheel steering apparatus shown in FIG. 1 taken from the port side.
Figure 3:
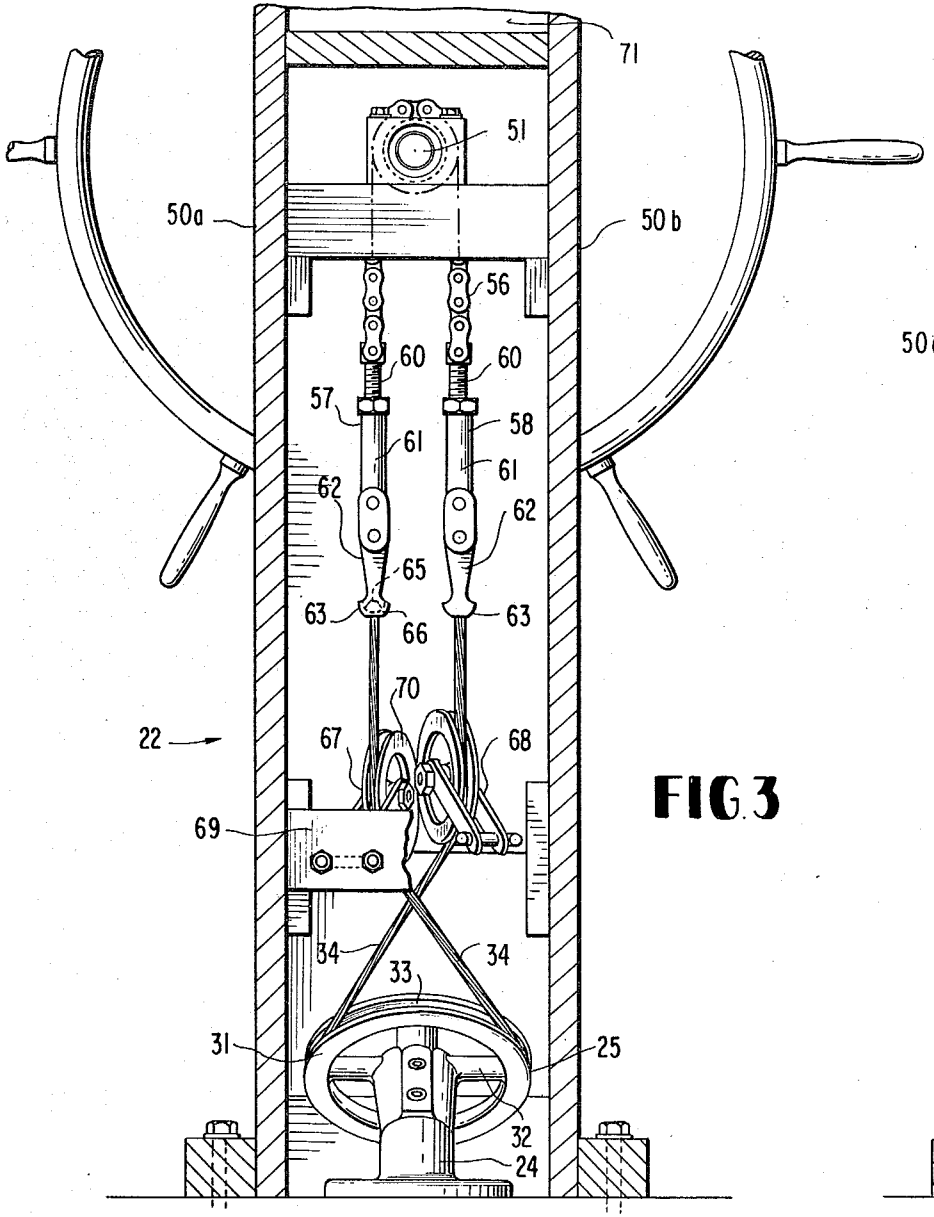
FIG. 3 is a sectional view taken along line 3—3 in FIG. 2.

Referring to FIGS. 2 and 3 bearing 24 mounts to the cockpit sole 15 and supports the rudder post 20. In accordance with this invention a sheave 25 is mounted to the exposed end of the rudder post 20 after the tiller is removed. The sheave 25, shown in FIGS. 4 and 5, comprises a hub 26 that has the same general construction as the removed tiller hub. In this specific embodiment it includes threaded openings 27*a* and 27*b* adapted to receive locking screws 28*a* and 28*b* that position the hub 26 on the rudder post 22. In other installations the tiller may include a simple cap screw that passes through the hub 26 into the rudder post 20. In addition, another nut and bolt assembly 29 passes through a "tangential" bore in the hub 26 thereby to clamp the hub 26 to the rudder post 20, as the hub 26 is cut longitudinally as shown by reference number 30. Thus, when the locking screws 28*a* and 28*b* and clamping nut and bolt assembly 29 are tightened, the sheave 25 is made fast to the rudder post 22, as shown in FIGS. 2 through 4.

A similar clamping action may be attained if the sheave 25 is made from two discrete pieces formed by effectively continuing the sawcut 30 through the sheave 25 and clamping the halves together on opposite sides of the rudder post. As apparent the halves actually can be cast or otherwise made as separate pieces.

Referring again to FIG. 4, the sheave also includes an annular portion 31 that is supported from the hub 26 by a web structure 32. A groove 33 is formed in the outer periphery of the portion 31 to seat a cable 34. In addition, one of the web structures 32 carries an integrally formed cable anchor assembly portion 35 including a radial bore 36. The bore 36 receives an anchor 40. A body portion 42 contains a socket 43 that receives a ball assembly 44. This assembly 44 is swaged onto the cable 34 at its midpoint. After the anchor 40 is located in the socket 43, it is also clamped when the nut and bolt assembly 29 in FIG. 2 is tightened as the cut 30 also passes through the anchor portion 35 and its supporting web. The cable 34 and assembly 44 also are retained on the socket 43 by tension on the cable 34.

After the sheave 25 is mounted to the rudder post 20, the remainder of the wheel steering apparatus 22, including a pedestal housing 50 is installed. The housing 50 includes side portions 50*a* and 50*b*, a portion 50*c* that faces aft and a vertical portion 50*d* that faces forward. The aft portion 50*c* terminates above the cockpit sole 15 and a sloped portion 50*e* then slopes toward the sole 15 over the sheave 25.

Still referring to FIGS. 2 and 3 the steering wheel 23 mounts to a shaft 51 that is carried by bearings 52 and 53. A sprocket 54 on the forward portion of the shaft 51 includes a hub portion 54*a* that acts as a thrust washer. A collar 55 on the shaft 51 at the aft portion of the shaft also acts as a thrust washer thereby to position the shaft 51 along its longitudinal axis.

A chain 56 lies on the sprocket 54 and includes turnbuckles 57 and 58 at the free ends thereof. Each of the turnbuckles 57 and 58 includes an externally threaded member 60 that connects to the free end of the chain 56 and an internally threaded member 61 that carries a clevis 62. A transverse portion 63 of the clevis has a slot formed therein to allow a ball 65 on the corresponding free end of the cable 34 to seat in a centrally disposed socket portion 66. There are disposed beneath the turnbuckles 57 and 58, respectively, blocks 67 and 68 that connect to a frame member 69 in the housing and are vertically offset with respect to each other. The blocks are disposed to pivot in planes that intersect. The blocks 67 and 68 perform two functions. In accordance with a first function, the blocks 67 and 68 direct the linkage within the housing so that the chain 56 lies in the plane of the sprocket 54 and so that the cable lies essentially in the plane of the sheave 25. That portion of the cable 34 that extends from the turnbuckle 57 passes around a cable sheave 70 in the block 67 and then to the opposite side (i.e., the right side in FIG. 3) of the sheave 25. The other half of the cable 34 from the left side of the sheave 25 (in FIG. 3), passes through the block 68 to the turnbuckle 58. As is apparent, the two cable halves 57 and 58 cross between the blocks 67 and 68 and the sheave 25. The vertical offset of the blocks 67 and 68 prevents interference which is the second function that the blocks perform. Thus, rotation of the steering wheel 23 produces the anticipated response in the boat (e.g., clockwise rotation in FIG. 1 causes the boat to turn to starboard).

There is also shown in FIGS. 1 through 3 a compartment 71 that is located above the shaft 51. This compartment 71 is formed in the pedestal to afford a mounting for a compass 72. The compass is supported by pivots on the side portions 50*a* and 50*b* so the outer gimbal axis is athwartship. It will also be apparent that compartment could be replaced by a conventional compass binnacle used with conventional pedestals.

As will be apparent from the disclosure, my wheel steering unit is simple to install. If a conversion is to be made, the tiller is removed first. In either a conversion or original installation, the sheave 25 is affixed to the rudder post 20. After housing 50 is properly positioned over the sheave 25, and the cable is strung around the sheave 25, the housing 50 can be bolted through the cockpit sole 15. The turnbuckles are then adjusted in order to properly align the wheel and the rudder and to provide the necessary tension in the chain and cable.

It will be apparent from this disclosure that there are many variations which can be made to my wheel steering apparatus with the attainment of some, if not all, of the enumerated advantages. For example, a single sprocket 54 has been shown. Such a sprocket can produce an effective steering force on the rudder of a small-to-medium size boat. Other gearing arrangements including parallel gear shafts or planetary gears could be used to obtain even greater mechanical advantage. Such substitutions are well known in the art. Moreover, it will be apparent that the specifically disclosed embodiment is suited particularly well for use in a boat on which the rudder post is exposed above the cockpit sole. It is also suited to boats in which the rudder post terminates below the sole. In such a case, pulleys corresponding to pulleys 67 and 68 would be disposed beneath the sole. Then the cable would pass vertically through small apertures formed in the sole to those pulleys and then to the sheave.

In summary, there is disclosed apparatus for easily converting a boat with tiller steering to one adapted for wheel steering. In accordance with the various objects and advantages of this invention, my wheel steering conversion apparatus is simple to install. It does not require any major structural changes to the boat other than merely removing the tiller itself from the rudder post. The individual elements that are formed are simple to produce and assemble.

Therefore, it is the object of the appended claims to cover all such variations and modifications as come within the true spirit and scope of my invention.

What I claim as new and desire to secure by letters Patent of the United States is:

1. A wheel steering apparatus to be mounted to the cockpit sole of a sailboat in which the sailboat includes a rudder, a rudder post with one end connected to the rudder and means on the cockpit sole for supporting, in an exposed position above the cockpit sole, the other end of said rudder post, said apparatus comprising:

A. sheave means including a sheave mounted to the exposed end of the rudder post in a plane that is normal thereto;

B. a housing mounted to the cockpit sole, said housing having a base portion for enclosing said sheave means and an upstanding hollow pedestal portion;

C. a shaft mounted in said pedestal portion of said housing;

D. a steering wheel mounted to said shaft for rotating said shaft;

E. drive means connected to said shaft for rotation with said steering wheel and shaft;

F. linkage means partially located in said pedestal portion for interconnecting said drive means and said sheave means, said sheave means including connection means for affixing said linkage means to said sheave in a positive driving relationship, and G. directing means mounted to said housing for orienting said linkage means to lie substantially normally to said shaft and to lie substantially in the plane of said sheave at said sheave means, said directing means maintaining said linkage within a beam dimension that is a maximum across said sheave whereby said housing encloses said sheave means and said linkage means thereby to provide a completely enclosed, compact steering apparatus for the sailboat.

* * * * *